US011002137B2

(12) United States Patent
Rudolph

(10) Patent No.: US 11,002,137 B2
(45) Date of Patent: May 11, 2021

(54) ENHANCED FILM COOLING SYSTEM

(71) Applicant: DOOSAN HEAVY INDUSTRIES & CONSTRUCTION CO., LTD., Changwon-si (KR)

(72) Inventor: Ronald Rudolph, Jensen Beach, FL (US)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 0 days.

(21) Appl. No.: 16/747,424

(22) Filed: Jan. 20, 2020

(65) Prior Publication Data

US 2020/0149410 A1 May 14, 2020

Related U.S. Application Data

(62) Division of application No. 15/722,311, filed on Oct. 2, 2017, now Pat. No. 10,570,747.

(51) Int. Cl.

| | |
|---|---|
| ***F01D 5/18*** | (2006.01) |
| ***F01D 5/14*** | (2006.01) |
| ***F01D 5/28*** | (2006.01) |
| ***C23C 8/04*** | (2006.01) |

(52) U.S. Cl.

CPC ..... *F01D 5/186* (2013.01); *C23C 8/04* (2013.01); *F01D 5/141* (2013.01); *F01D 5/185* (2013.01); *F01D 5/189* (2013.01); *F01D 5/288* (2013.01); *F05D 2240/12* (2013.01); *F05D 2250/294* (2013.01); *F05D 2260/202* (2013.01)

(58) Field of Classification Search

CPC . F01D 5/186; F05D 2250/14; F05D 2260/202

See application file for complete search history.

(56) References Cited

U.S. PATENT DOCUMENTS

| | | | | |
|---|---|---|---|---|
| 4,650,949 A * | 3/1987 | Field | B23H 9/14 | 219/69.15 |
| 5,985,122 A * | 11/1999 | Conner | C25D 5/022 | 205/122 |
| 6,224,339 B1 * | 5/2001 | Rhodes | F01D 5/186 | 416/224 |
| 6,234,755 B1 | 5/2001 | Bunker | | |

(Continued)

FOREIGN PATENT DOCUMENTS

| | | |
|---|---|---|
| KR | 2013-0041893 A | 4/2013 |
| KR | 2017-0063822 A | 6/2017 |

*Primary Examiner* — Kevin R Steckbauer

(74) *Attorney, Agent, or Firm* — Invenstone Patent, LLC

(57) ABSTRACT

A turbine blade in an industrial gas turbine includes a blade surface to be cooled by a film of cooling fluid, a plurality of cooling holes on the blade surface through which cooling fluid flows, each cooling hole including an inlet portion and an outlet portion, and a trench on the blade surface surrounding at least one outlet portion of the cooling hole, the trench extending in an axial direction and a radial direction from the outlet portion of the cooling hole, wherein the outlet portion of the cooling hole has a shape configured to generate a first stage diffusion of the cooling fluid and a wall of the trench is positioned in the axial direction from the outlet portion of the cooling hole to generate a second stage diffusion of the cooling fluid, thereby forming the film of cooling fluid.

12 Claims, 10 Drawing Sheets

(56) References Cited

U.S. PATENT DOCUMENTS 6,630,645 B2 * 10/2003 Richter ..... B23K 26/389 219/121.71
7,019,257 B2 * 3/2006 Stevens ..... B23K 26/389 219/121.71
7,024,787 B2 * 4/2006 Varsell ..... G01B 3/14 33/562
7,387,817 B2 * 6/2008 Becze ..... C23C 8/04 427/272
7,553,534 B2 * 6/2009 Bunker ..... F01D 5/186 415/115
8,066,484 B1 * 11/2011 Liang ..... F01D 5/186 416/97 R
8,079,812 B2 * 12/2011 Okita ..... F01D 9/065 416/97 R
8,105,030 B2 * 1/2012 Abdel-Messeh ..... F01D 5/187 416/95
8,245,519 B1 * 8/2012 Liang ..... F01D 5/186 60/806
8,292,580 B2 * 10/2012 Schiavo ..... F01D 5/189 416/96 A
8,516,974 B2 * 8/2013 Woodard ..... B05B 14/30 118/320
8,608,443 B2 * 12/2013 Lee ..... F01D 25/12 416/97 R
8,684,691 B2 * 4/2014 Lee ..... F01D 5/20 416/92
8,870,535 B2 * 10/2014 Lacy ..... F01D 5/186 416/97 R
8,870,536 B2 * 10/2014 Lacy ..... F01D 5/186 416/97 R
9,022,737 B2 * 5/2015 Piggush ..... F01D 5/186 416/97 R
9,028,207 B2 * 5/2015 Zuniga ..... F01D 5/186 415/178
9,080,451 B2 * 7/2015 Simpson ..... F01D 5/186
9,121,091 B2 * 9/2015 Everett ..... B05C 17/06
9,441,488 B1 * 9/2016 Johnson ..... F01D 5/186
9,890,647 B2 * 2/2018 Chamberlain ..... B23H 9/10
10,221,693 B2 * 3/2019 Chan ..... F01D 5/143
10,408,079 B2 * 9/2019 Merrill ..... F01D 11/127
2003/0127438 A1 * 7/2003 Richter ..... F01D 5/186 219/121.71
2005/0217131 A1 * 10/2005 Varsell ..... G01B 3/14 33/562
2006/0222773 A1 * 10/2006 Becze ..... C23C 10/04 427/282
2007/0128029 A1 * 6/2007 Liang ..... F01D 5/187 416/97 R
2008/0286090 A1 * 11/2008 Okita ..... F01D 9/065 415/115
2009/0246011 A1 * 10/2009 Itzel ..... F01D 5/186 415/208.1
2010/0040478 A1 * 2/2010 Abdel-Messeh ..... F01D 5/187 416/97 R
2010/0068034 A1 * 3/2010 Schiavo ..... F01D 5/282 415/115
2011/0097188 A1 * 4/2011 Bunker ..... F01D 5/186 415/1
2011/0158820 A1 * 6/2011 Chamberlain ..... F01D 5/284 416/97 R
2011/0305582 A1 * 12/2011 Lee ..... F01D 5/20 416/97 R
2012/0076644 A1 * 3/2012 Zuniga ..... F01D 5/186 415/178
2012/0084981 A1 * 4/2012 Arikawa ..... F01D 5/186 29/889.721
2012/0282108 A1 * 11/2012 Lee ..... F01D 5/20 416/97 R
2013/0039777 A1 * 2/2013 Piggush ..... F01D 5/186 416/97 R
2013/0052344 A1 * 2/2013 Woodard ..... B05B 7/04 427/230
2013/0183165 A1 * 7/2013 Lacy ..... F01D 5/186 416/97 R
2013/0183166 A1 * 7/2013 Lacy ..... F01D 5/186 416/97 R
2013/0189115 A1 * 7/2013 Everett ..... B05C 17/06 416/241 R
2013/0302177 A1 * 11/2013 Bergholz, Jr. ..... F01D 5/187 416/97 R
2014/0003960 A1 * 1/2014 Simpson ..... F01D 5/186 416/97 R
2014/0037429 A1 * 2/2014 Okita ..... F01D 5/186 415/115
2016/0169004 A1 * 6/2016 Quach ..... F01D 9/041 60/752
2016/0369633 A1 * 12/2016 Chan ..... F04D 29/324
2017/0022821 A1 * 1/2017 Ferber ..... F01D 5/147
2017/0175534 A1 * 6/2017 Ferber ..... F01D 5/187
2017/0297054 A1 * 10/2017 Torigoe ..... B05D 3/062
2018/0023399 A1 * 1/2018 Merrill ..... C23C 28/3455 29/889.721

* cited by examiner

ENHANCED FILM COOLING SYSTEM

CROSS-REFERENCE TO RELATED APPLICATIONS

This application is a divisional of U.S. application Ser. No. 15/722,311, filed on Oct. 2, 2017.

BACKGROUND

Combustors, such as those used in gas turbines, for example, mix compressed air with fuel and expel high temperature, high pressure gas downstream. The energy stored in the gas is then converted to work as the high temperature, high pressure gas expands in a turbine, for example, thereby turning a shaft to drive attached devices, such as an electric generator to generate electricity. The shaft has a plurality of turbine blades shaped such that the expanding hot gas creates a pressure imbalance as it travels from the leading edge to the trailing edge, thereby turning the turbine blades to rotate the shaft.

FIG. 1 shows a gas turbine 20. Air to be supplied to the combustor 10 is received through air intake section 30 of the gas turbine 20 and is compressed in compression section 40. The compressed air is then supplied to headend 50 through air path 60. The air is mixed with fuel and combusted at the tip of nozzles 70 and the resulting high temperature, high pressure gas is supplied downstream. In the exemplary embodiment shown in FIG. 1, the resulting gas is supplied to turbine section 80 where the energy of the gas is converted to work by turning shaft 90 connected to turbine blades 95.

As shown in FIG. 2, in order to cool the turbine blades 95 where prolonged exposure to high heat can cause deformation and even structural failure, cooling holes 100 are formed on the surface of the turbine blade 95. As cooling fluid, such as cooled air, is forced out through the cooling holes 100 at high velocities, a boundary layer of cooling fluid covers the surface of the turbine blade 95 thereby cooling the turbine blade 95.

A thin steady film of cold air formed on the blade is ideal to keep the blade cool. However, typical round film holes experiences a significant reduction in film effectiveness for high blowing ratios. As shown in FIG. 3, at low (Low M) to moderate (Mod M) blowing ratios, a relatively steady boundary layer is formed from the cooling fluid escaping through the cooling hole 100 to create a cooling film 300. However, at high blowing ratios (High M), the boundary layer is disrupted by turbulence 310 and the cooling effect from the cooling fluid is significantly reduced.

In addition, the typical method of forming and ceramic coating of the film holes leaves a jagged edge around the film holes that disrupt the formation of the boundary layer thereby reducing the cooling effect. Typically, the film holes are drilled into the surface of the turbine blade using electrical discharge machining (EDM) or some form of laser. The turbine blade 95 is then coated with a thermal barrier coating (TBC) material, such as ceramic. Assuming the more common EDM manufacturing process is used and because TBC material is an insulator and EDM is only effective on metal surfaces, the film holes are formed before the coating process. Accordingly, the coating process requires plugging the film holes prior to coating the surface of the turbine blade and removing the plugging materials after the coating process is complete. The plugging material, which is typically a type of polymer, leaves a residue that creates a jagged edge around the film holes thereby reducing performance of the cooling effect.

BRIEF SUMMARY

In an embodiment, a turbine blade in an industrial gas turbine includes a blade surface to be cooled by a film of cooling fluid, a plurality of cooling holes on the blade surface through which cooling fluid flows, each cooling hole including an inlet portion and an outlet portion, and a trench on the blade surface surrounding at least one outlet portion of the cooling hole, the trench extending in an axial direction and a radial direction from the outlet portion of the cooling hole, wherein the outlet portion of the cooling hole has a shape configured to generate a first stage diffusion of the cooling fluid and a wall of the trench is positioned in the axial direction from the outlet portion of the cooling hole to generate a second stage diffusion of the cooling fluid, thereby forming the film of cooling fluid.

In another embodiment, a turbine includes a rotating shaft, and one or more turbine blades connected to the rotating shaft, each turbine blade including a blade surface to be cooled by a film of cooling fluid a plurality of cooling holes on the blade surface through which cooling fluid flows, each cooling hole including an inlet portion and an outlet portion, and a trench on the blade surface surrounding at least one outlet portion of the cooling hole, the trench extending in an axial direction and a radial direction from the outlet portion of the cooling hole, wherein the outlet portion of the cooling hole has a shape configured to generate a first stage diffusion of the cooling fluid and a wall of the trench is positioned in the axial direction from the outlet portion of the cooling hole to generate a second stage diffusion of the cooling fluid, thereby forming the film of cooling fluid.

In yet another embodiment, a masking apparatus for a turbine blade in an industrial gas turbine includes a base configured to fit over a tip of the turbine blade, and one or more masking arms extending from the base in a radial direction and configured to cover a plurality of cooling holes formed on a surface of the turbine blade to form a trench surrounding the plurality of cooling holes.

DETAILED DESCRIPTION

Various embodiments of an enhanced film cooling system in an industrial gas turbine are described. It is to be understood, however, that the following explanation is merely exemplary in describing the devices and methods of the present disclosure. Accordingly, any number of reasonable and foreseeable modifications, changes, and/or substitutions are contemplated without departing from the spirit and scope of the present disclosure.

Figure 1:
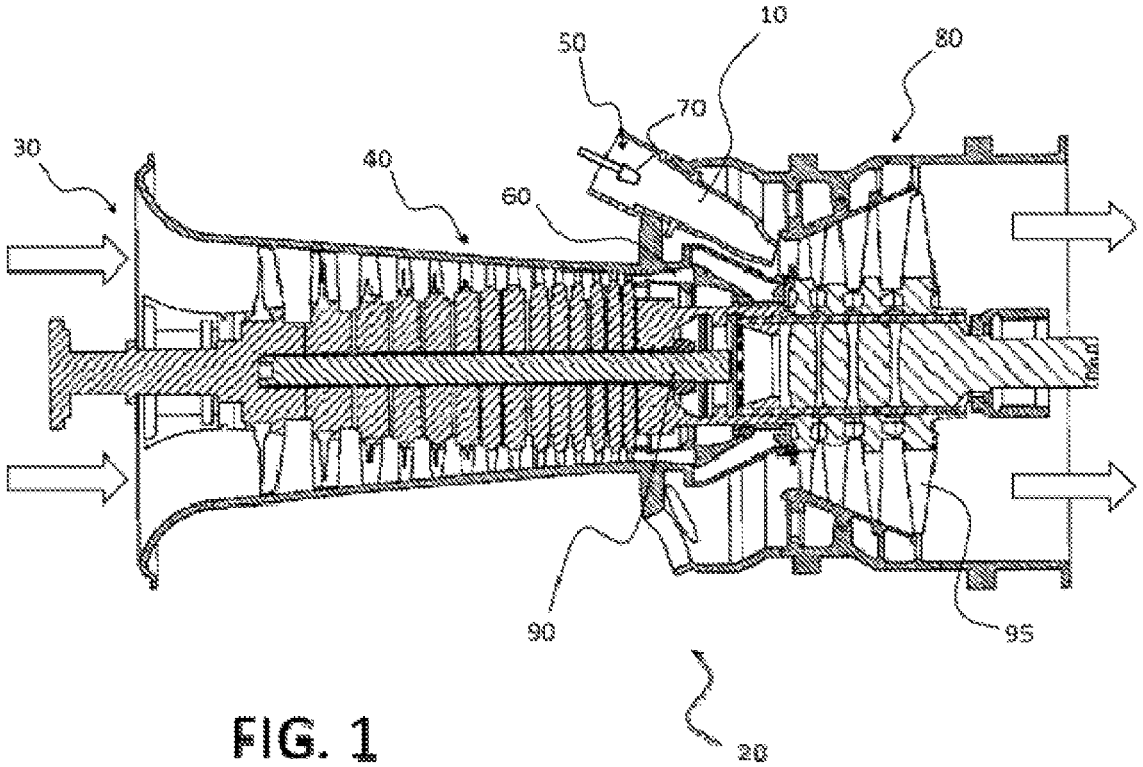
FIG. 1 is a cross sectional view of an industrial gas turbine.
Figure 2:
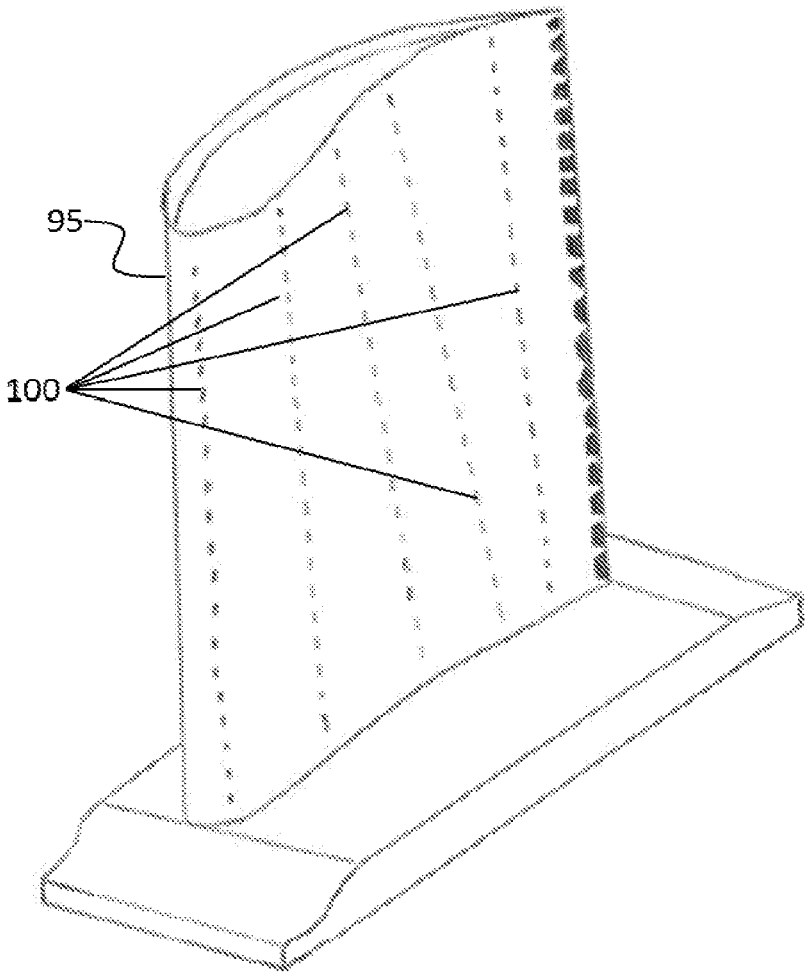
FIG. 2 is a perspective view of a turbine blade.
Figure 3:
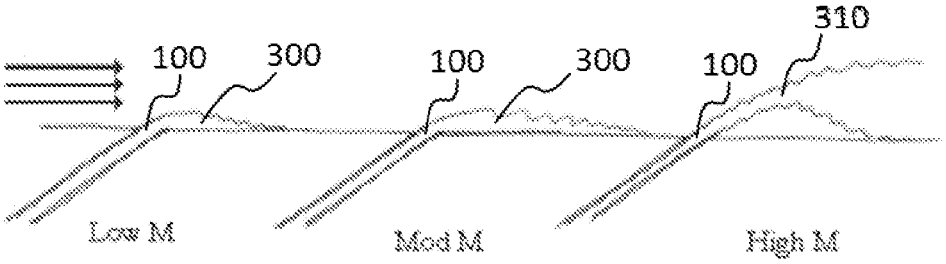
FIG. 3 is a diagram depicting the boundary conditions at a cooling hole under different blowing ratios.
Figure 4:
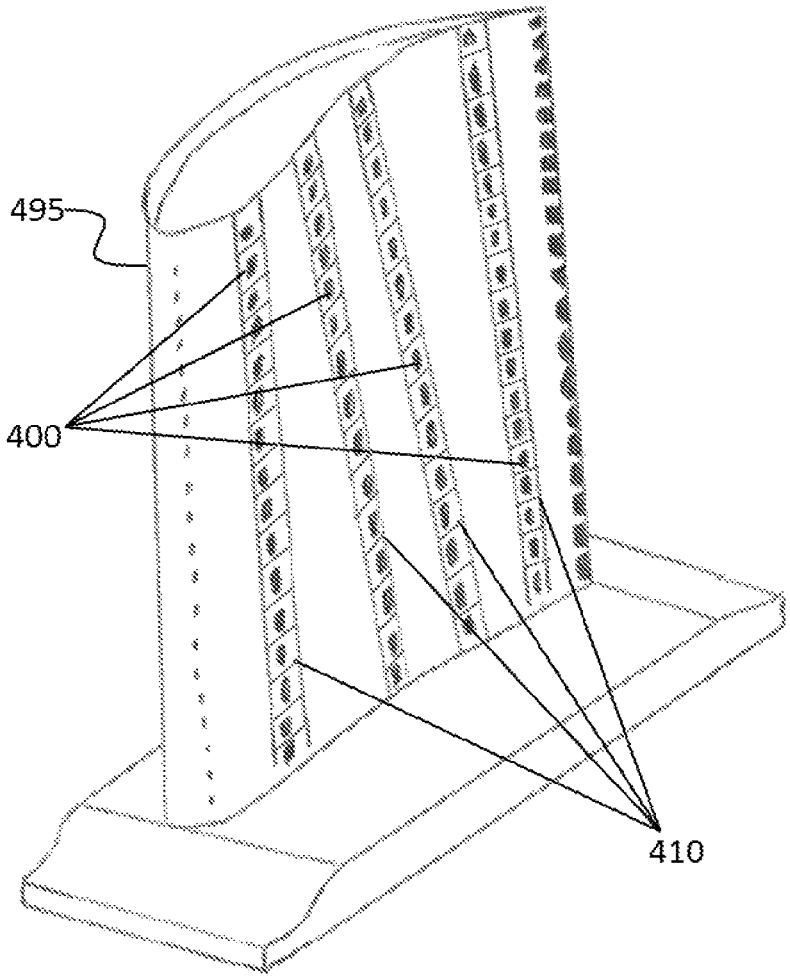
FIG. 4 is a perspective view of a turbine blade according to an exemplary embodiment.

FIG. 4 is a perspective view of an exemplary embodiment. Turbine blade 495 according to an exemplary embodiment includes a plurality of cooling holes 400 arranged in trench 410.

Figure 5A:
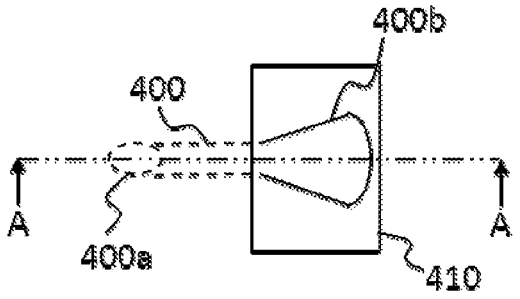
FIG. 5A and 5B are top views of various cooling holes according to a first exemplary embodiment.
Figure 5B:
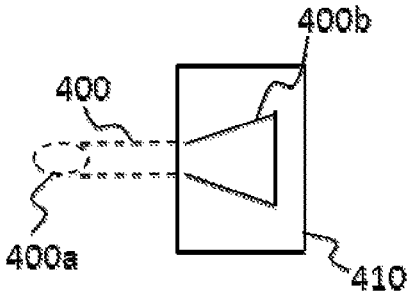

As shown in FIG. 5A, each cooling hole 400 has an inlet 400*a* and outlet 400*b*. In an exemplary embodiment, inlet 400*a* has a round shape for good flow control management while outlet 400*b* has a fan shape to diffuse the cooling fluid exiting from the outlet 400*b*. However, it is to be understood that other shapes for inlet 400*a* and outlet 400*b* may be used. For example, the outlet 400*b* may be a trapezoidal shape as shown in FIG. 5B. Other shapes may be used without departing from the scope of the present disclosure.

Figure 6:
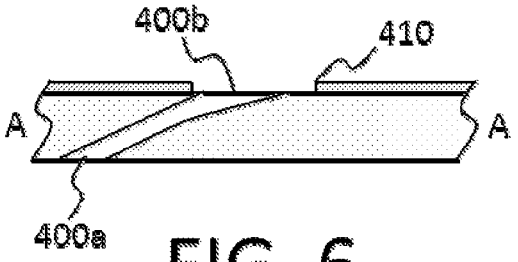
FIG. 6 is a cross sectional view of the cooling hole according to the first exemplary embodiment.
Figure 7:
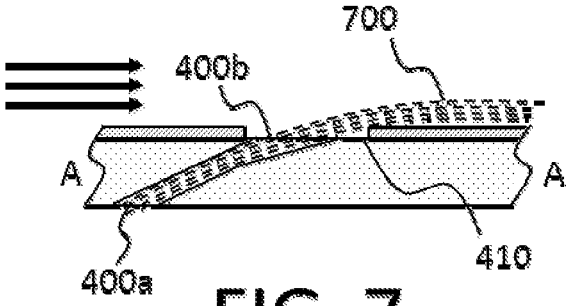
FIG. 7 is a diagram depicting the boundary conditions at the cooling hole according to the first exemplary embodiment.

In an exemplary embodiment, each outlet 400*b* of cooling hole 400 is surrounded by a trench 410. The trench 410 is located at the exit of the outlet 400*b* and extends axially and radially from the outlet 400*b* to act as a second stage diffuser. FIGS. 6 and 7 show a cross section on the embodiment shown in FIG. 5A along line A-A. Accordingly, as shown in FIG. 7, even under a high blow ratio, a boundary layer of the cooling fluid existing from the outlet 400*h* is formed to create a cooling film 700.

Figure 8:
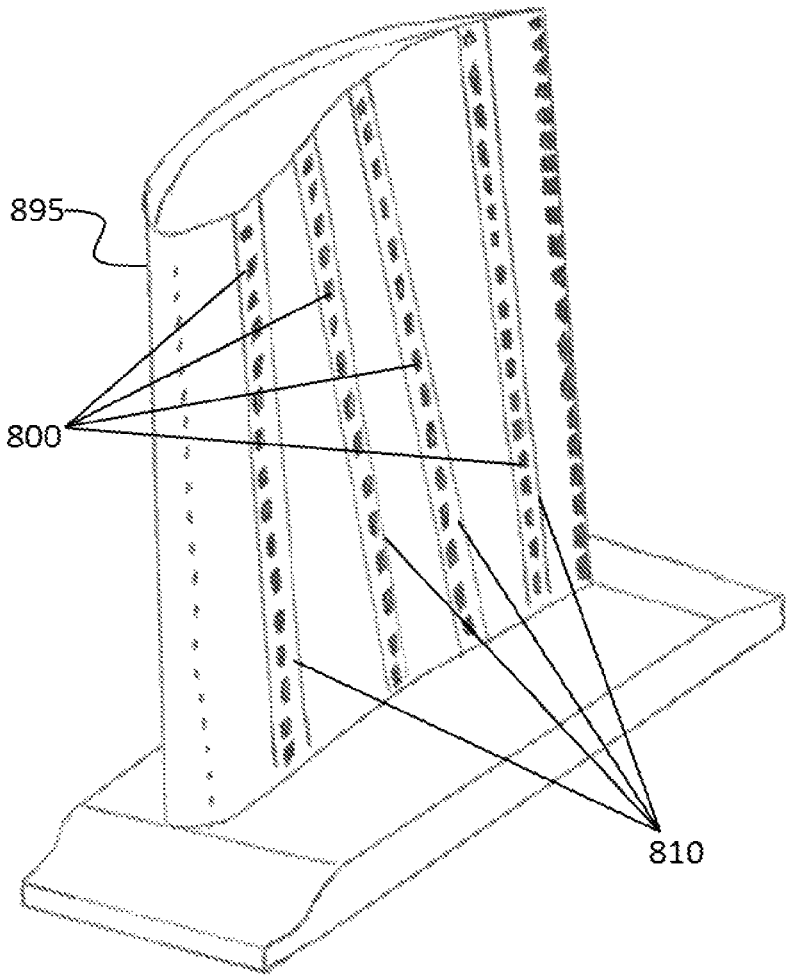
FIG. 8 is a perspective view of another exemplary embodiment.

FIG. 8 is a perspective view of another exemplary embodiment. Turbine blade 895 according to an exemplary embodiment includes a plurality of cooling holes 800 arranged in trench 810. The cooling holes 800 has the same configuration as cooling holes 400 as shown in FIGS. 5 and 6. Like cooling holes 400, it is to be understood that other shapes for cooling holes 800 may be used.

Figure 9:
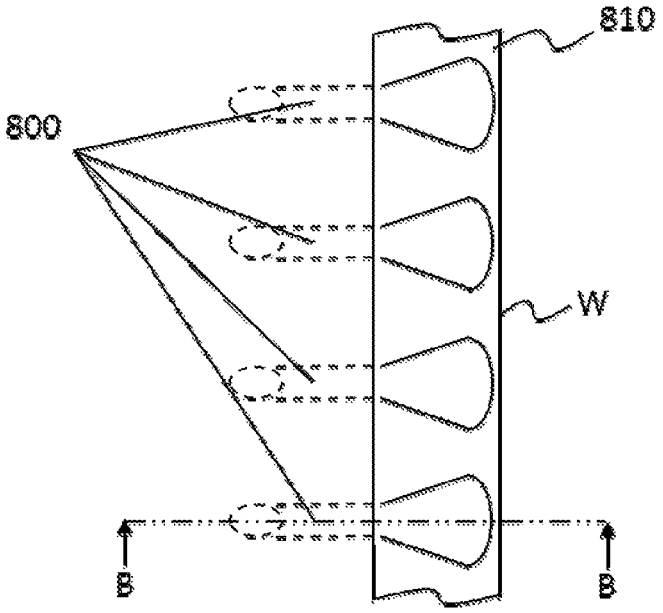
FIG. 9 is a top view of cooling holes according to a second exemplary embodiment.
Figure 10:
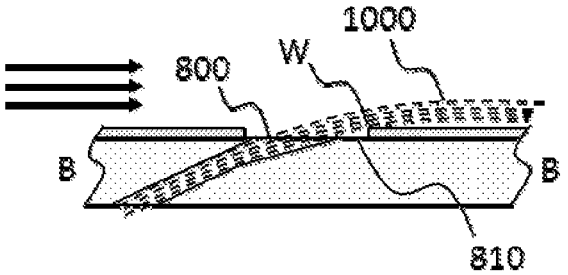
FIG. 10 is a diagram depicting the boundary conditions at the cooling holes according to the second exemplary embodiment.

As shown in FIG. 9, a plurality of cooling holes 800 are surrounded by a trench 810. In an exemplary embodiment, each trench 810 extends in the radial direction such that a plurality of cooling holes 800 are arranged in each trench 810 and an outlet portion of each cooling hole 800 in the same trench 810 is arranged near wall W of the trench 810 that extend in the axial direction from the edge of the outlet portion of each cooling hole 800. Accordingly, as shown in FIG. 10 viewed along cross sectional line B-B, even under a high blow ratio, a boundary layer of the cooling fluid existing from the outlet portion of cooling hole 800 is formed to create a cooling film 1000.

Figure 11:
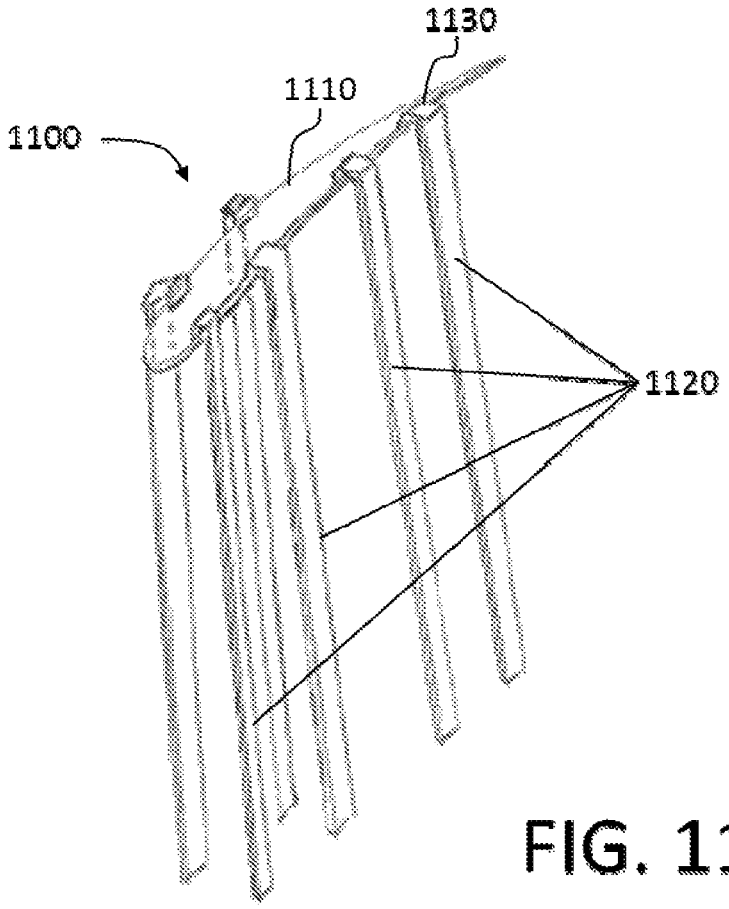
FIG. 11 is a perspective view of a masking apparatus in accordance with an exemplary embodiment.

FIG. 11 is a perspective view of an exemplary embodiment of a masking apparatus 1100. The masking apparatus 1100 includes a base plate 1110 and a plurality of masking arms 1120 that extend from the base plate 1110. In an exemplary embodiment, each of the plurality of masking arms 1120 includes a hook portion 1130 such that one end of the hook portion 1130 is connected to the base plate 1110. Other configurations, such as a flange forming an L-shape may be used to connect one end of the masking arm 1120 to the base plate 1110.

In one exemplary embodiment, the masking arms 1120 are fixedly connected to the base plate 1110, such as by solder, weld, or rivet, for example. In another exemplary embodiment, the masking arms 1120 are removably connected to the base plate 1110, such as by screws or nuts and bolts, for example. In yet another exemplary embodiment, the masking arms 1120 are rotatably connected to the base plate 1110, such as by a hinge, for example.

Figure 12:
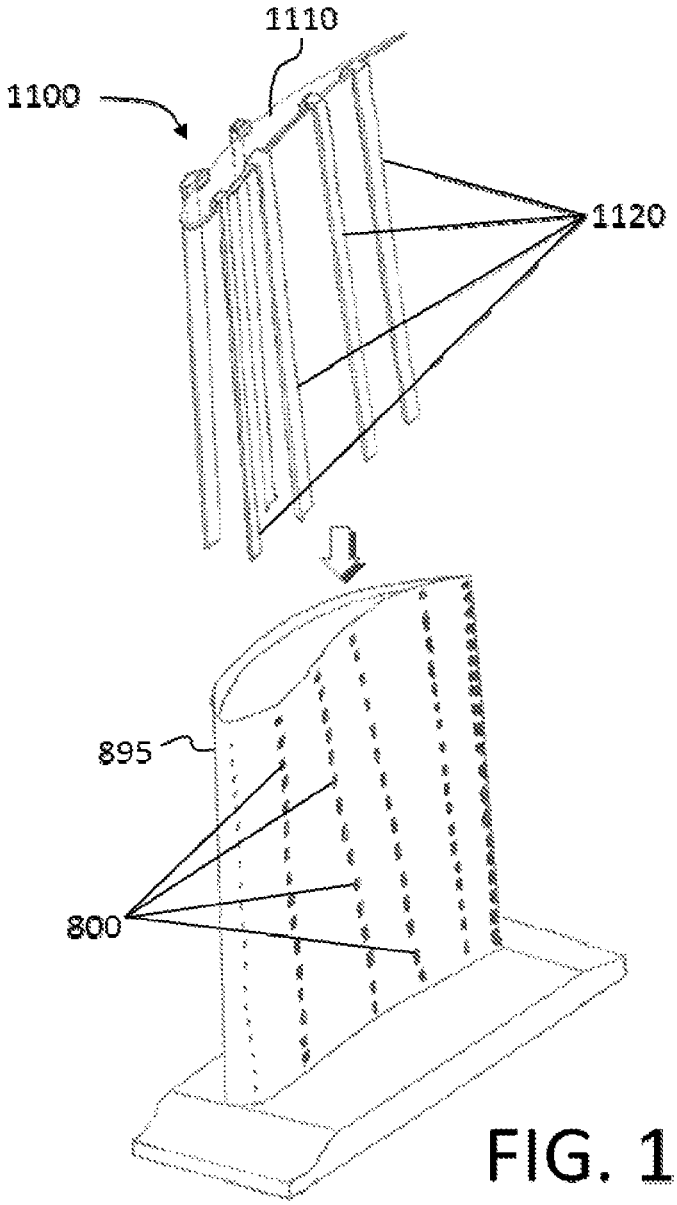
FIG. 12 is a perspective view of the masking apparatus in operation before coating a turbine blade in accordance with an exemplary embodiment.
Figure 13:
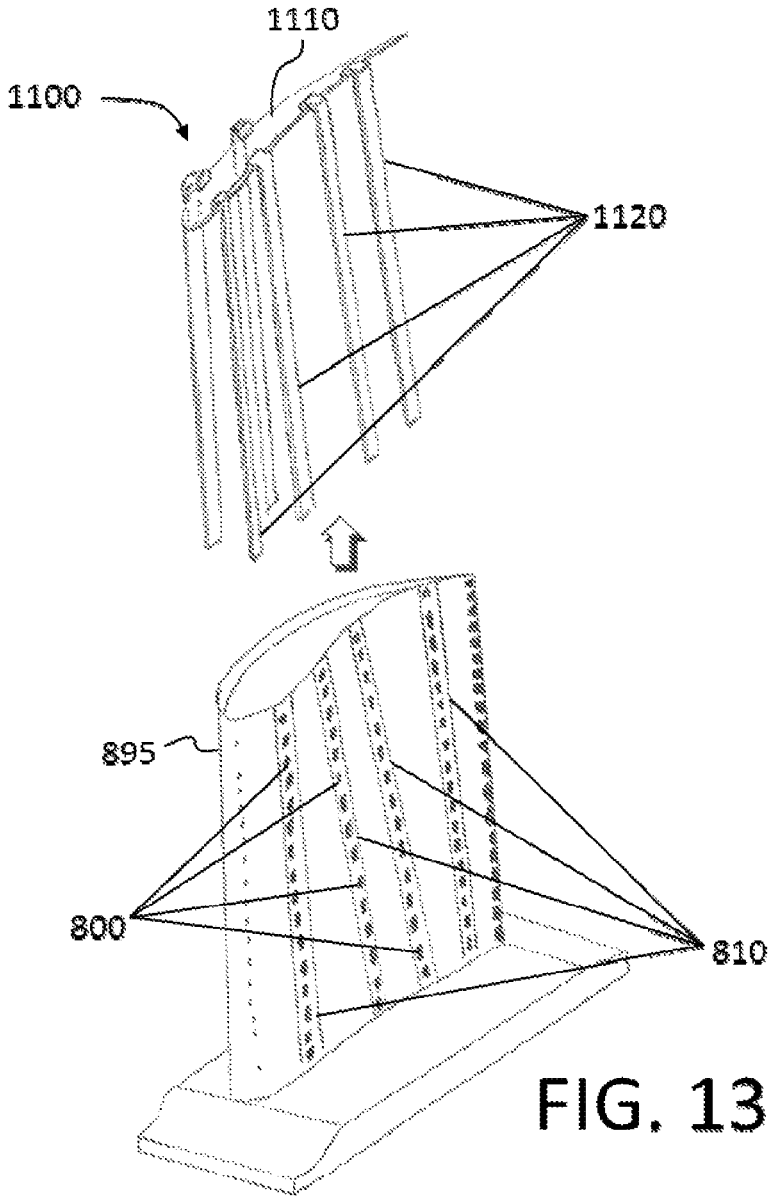
FIG. 13 is a perspective view of the masking apparatus in operation after coating the turbine blade in accordance with an exemplary embodiment.

As shown in FIG. 12, the base plate 1110 and the plurality of masking arms 1120 of the masking apparatus 1100 are configured to fit over the turbine blade 895 such that the masking arms 1120 are arranged over the cooling holes 800. After the masking apparatus 1100 have been placed over the turbine blade 895, the turbine blade 895 is coated with TBC material. As shown in FIG. 13, the masking apparatus 1100 is removed after the turbine blade 895 has been coated with TBC material leaving trenches 810 around select cooling holes 800 in a configuration left by masking arms 1120.

By virtue of the masking apparatus 1100, expensive and time consuming task of plugging and unplugging the cooling holes are eliminated while leaving no residue around the cooling holes that disrupt the flow of cooling fluid that exit from the cooling holes. Further, by shaping the outlet portion of the cooling holes to generate a first level of diffusion and surrounding the outlet portion of the cooling holes with a trench to generate a second level of diffusion, the film cooling effectiveness over a broad range of blowing and momentum flux ratios are optimized depending on the gas side boundary conditions at the cooling hole exit plane. Additional advantages can be achieved by tailoring the size, shape, and depth of the trenches that are easily configured by designing the masking apparatus accordingly, thereby simplifying what is otherwise a time consuming and expensive process that leaves imperfections around the cooling holes that degrades cooling performance.

The breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A masking apparatus for a turbine blade of a gas turbine, the turbine blade having a blade surface in which a plurality of cooling holes are arranged in a radial direction of the turbine blade, the masking apparatus comprising:

a base plate configured to fit over a tip of the turbine blade; and a masking arm extending from the base plate in the radial direction and including one end having a connecting structure connected to the base plate, the masking arm configured to cover the plurality of cooling holes.

2. The masking apparatus of claim 1, wherein the masking arm is further configured to block a thermal barrier coating (TBC) material applied to the blade surface and to form a trench in the TBC material.

3. The masking apparatus of claim 2, wherein the masking arm includes a plurality of masking arms configured such that the trench is formed as a plurality of trenches arranged in the radial direction in correspondence to the arrangement of the plurality of cooling holes.

4. The masking apparatus of claim 2, wherein the masking arm is further configured such that the trench is formed so as to surround the plurality of cooling holes.

5. The masking apparatus of claim 2, wherein the masking arm is further configured such that the trench is formed to have a width extending in an axial direction, a length extending in the radial direction, and a height equal to a thickness of the TBC material deposited on the blade surface.

6. The masking apparatus of claim 2, wherein the masking arm is further configured such that the trench is formed to have a downstream wall that extends in the radial direction for the length of the trench, the downstream wall having a flat continuous surface facing outlets of the plurality of cooling holes.

7. The masking apparatus of claim 6, wherein the masking arm is further configured such that the downstream wall of the trench is disposed so as to be offset in the axial direction from the cooling hole outlets in order to generate a second stage diffusion of cooling fluid subsequent to a first stage diffusion of the cooling fluid respectively exiting the cooling hole outlets.

8. The masking apparatus of claim 1, wherein the connecting structure of the masking arm includes a hook portion connected to the base plate.

9. The masking apparatus of claim 1, wherein the connecting structure of the masking arm includes a hinge connected to the base plate to enable the masking arm to rotate with respect to the base plate.

10. The masking apparatus of claim 1, wherein the connecting structure of the masking arm includes a L-shaped flange having one end connected to the base plate.

11. The masking apparatus of claim 1, wherein the connecting structure of the masking arm is configured to be fixedly connected to the base plate by one of soldering, welding, and riveting.

12. The masking apparatus of claim 1, wherein the connecting structure of the masking arm is configured to be removably connected to the base plate by a fastening device including at least one of a screw, a nut, and a bolt.

* * * * *